US006571977B2

(12) United States Patent
Goncalez et al.

(10) Patent No.: US 6,571,977 B2
(45) Date of Patent: Jun. 3, 2003

(54) DUAL CONTAINER

(76) Inventors: Isaias Goncalez, 123 Cavo Dr., Poughkeepsie, NY (US) 12603; Richard Volk, 124 Cavo Dr., Poughkeepsie, NY (US) 12603

( * ) Notice: Subject to any disclaimer, the term of this patent is extended or adjusted under 35 U.S.C. 154(b) by 188 days.

(21) Appl. No.: 09/956,391

(22) Filed: Sep. 20, 2001

(65) Prior Publication Data

US 2003/0052130 A1 Mar. 20, 2003

(51) Int. Cl.[7] ..... B65D 1/24

(52) U.S. Cl. ..... 220/506; 220/606; 220/633; 215/6

(58) Field of Search ..... 220/506, 635, 220/636, 606, 633, 23.83, 23.87; 215/6

(56) References Cited

U.S. PATENT DOCUMENTS

| | | | | | |
|---|---|---|---|---|---|
| 1,954,369 | A | * | 4/1934 | Solomon | 215/6 |
| 2,321,998 | A | * | 6/1943 | Crouch et al. | 215/6 |
| 2,468,661 | A | * | 4/1949 | Gladstone | 215/6 X |
| 2,494,456 | A | * | 1/1950 | Still | 215/6 X |
| 3,031,104 | A | | 4/1962 | Moskovitz | 222/94 |
| 3,459,295 | A | * | 8/1969 | Cousar | 215/6 X |
| 3,590,989 | A | * | 7/1971 | Wittwer | 215/6 X |
| 4,700,864 | A | | 10/1987 | Galles et al. | 220/86 |
| 4,964,539 | A | | 10/1990 | Mueller | 222/94 |
| 5,102,013 | A | | 4/1992 | Schneider et al. | 222/94 |
| 5,261,543 | A | * | 11/1993 | Ugarelli | 220/606 X |
| 5,328,056 | A | | 7/1994 | Schneider et al. | 222/94 |
| 5,427,258 | A | * | 6/1995 | Krishnakumar et al. | 220/633 X |
| 5,890,616 | A | | 4/1999 | Cravens et al. | 220/495.08 |
| 5,897,007 | A | * | 4/1999 | Schein et al. | 215/6 X |
| 5,921,369 | A | | 7/1999 | Steele | 193/25 R |
| 5,941,420 | A | | 8/1999 | Connan | 222/94 |
| 6,085,927 | A | * | 7/2000 | Kusz | 215/6 X |
| 6,220,311 | B1 | | 4/2001 | Litto | 141/67 |

* cited by examiner

*Primary Examiner*—Steven Pollard

(57) ABSTRACT

A dual container having an outer container with an inner container aligned centrally within the outer container with the base of the inner container retained by the base of the outer container, each container having a separate access port.

6 Claims, 4 Drawing Sheets

DUAL CONTAINER

BACKGROUND OF THE INVENTION

1. Field of the Invention

This invention relates to containers and more particularly to a dual container with two separate containers, one within the other, for the storage of the same or different. material within one dual container.

2. Prior Art and Objects

Many types of containers are available today. One of the most common types of such containers are bottles used for storage of drinks such as soda. These bottles, frequently made of plastic or glass, are offered to the consuming public in various sizes with large sizes offering greater economy. With large containers, unless the beverage is consumed quickly, it goes flat and is no longer satisfactory to the consumer.

Two chambered bottles or containers have been constructed in the past. One example can be found in the Markazov Patent, U.S. Pat. No. D3,332,635, where two side by side compartments were used.

The Riordan Patent, U.S. Pat. No. 6,105,812 also teaches a dual chamber container but with the compartments connected end to end. The capped apertures at both ends of the container, used to remove the material from within the compartments, are located within well areas situated at both ends.

The Litto Patent, U.S. Pat. No. 6,220,311 B1, shows a compartment within a compartment but is clearly distinct from the current invention. Litto uses an inner container, which is expandable, to fill space outside the inner container, when material from the outside container is removed. It should be noted that the expandable inner container is connected at the upper end without any restraint at the lower end. In view of the design of the inner compartment and its purpose, as taught by Litto, there is no reason to secure the base of the inner compartment.

By placing the inner compartment centrally within the outer compartment and along a common longitudinal axis while restraining the base of the inner compartment in the base of outer container, a dual container of two containers is produced that is balanced so that consumption of the material in either compartment does not cause imbalance. Both containers forming the dual container would preferably be made of the same material. Such a container provides two compartments that can store the same or different products. Even with the same material being stored, the opening of one compartment does not in any way diminish the freshness of the material in the other compartment. Similarly, a variety of materials can be dispensed in one container, as for example a diet beverage and a regular beverage.

One of the most obvious uses, but not the only, for a dual container is in the soft drink market which has a wide spread consumption of containers, usually made of plastic. This invention is not limited to any specific material and may be used with plastic, glass and metal containers. However, with plastic containers it is very suitable as it can be readily and easily used and when empty may be recycled.

Accordingly, it is an object of the present invention to provide a dual container formed with an outer compartment and a inner compartment centrally within the outer compartment.

It is another object of the present invention to provide a dual container that retains physical stability when one container within the dual container is partially or fully emptied.

It is still another object of the present invention to provide a dual container that may be constructed from containers of existing design.

It is still a further object of the present invention to provide a dual container that may be economically constructed.

SUMMARY OF THE INVENTION

A two-compartment container is provided with an inner compartment located centrally within the outer compartment. Both the inner container and the outer container have an upper end with a central opening. Each central opening is substantially along the centerline of the dual container and at the upper end and the opening of the inner container is tightly secured, so as to avoid leakage, within the central opening of the outer container. The central opening of the inner container is utilized to dispense material from within that inner compartment. Since the central opening of the outer container is blocked by the central opening of the inner container, a side or alternate opening, adjacent the central openings, is provided for dispensing material from the outer container.

The inner container and the outer container each have a base plate with some form of indentation and protrusion the base plates. The indentations and protrusions may be of various configurations but, in accordance with this invention, must be sufficiently similar so that the inner container is retained at its lower end as a result of the protrusions and the indentations. Although limited movement of the inner container within the outer container is possible, since the fit between the protrusions and the indentations need not be tight, the base of the inner container is prevented from any substantial movement that would break the inner container at the central opening.

DETAILED DESCRIPTION OF THE DRAWINGS

Figure 2:
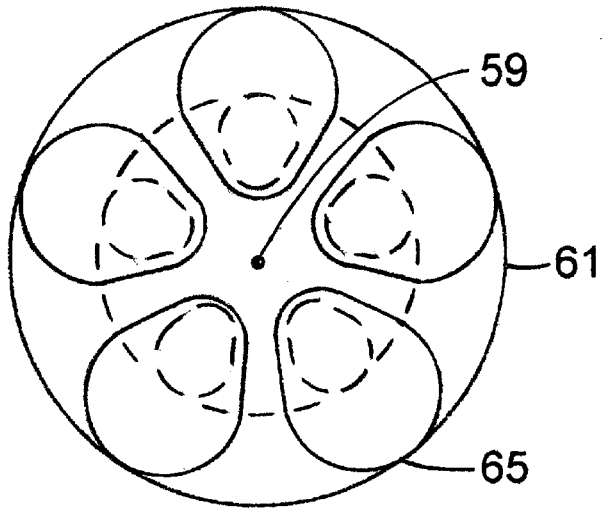
FIG. 2 is plan view of the base of the outer container, utilizing a five footed design, commonly in use.
Figure 2A:
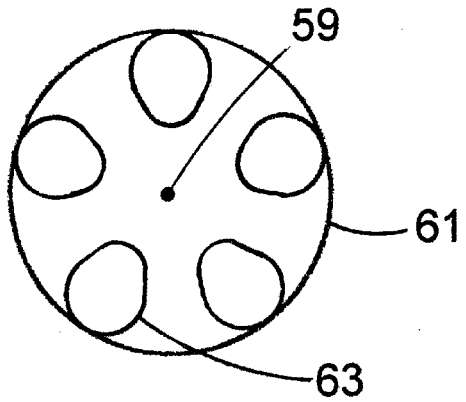

FIG. 2*a* is a plan view of the base of the inner container also utilizing the same five-footed design.

Figure 2B:
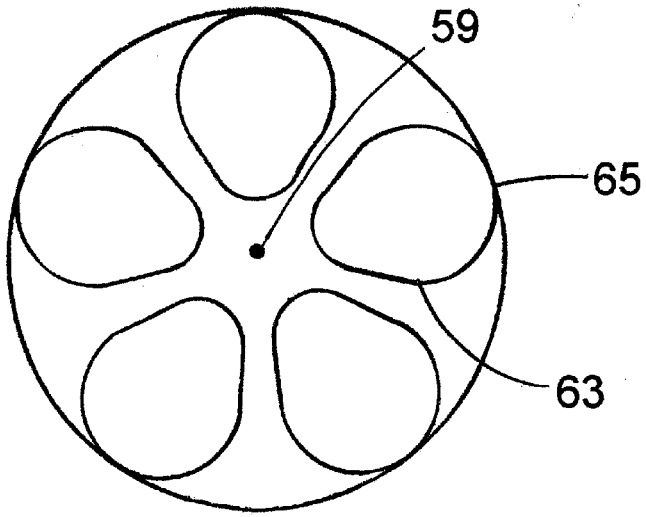

FIG. 2*b* is a plan view of the base of the outer container, utilizing the five-footed design commonly in use, and showing the base of the inner container in phantom in place within the outer container.

Figure 3:
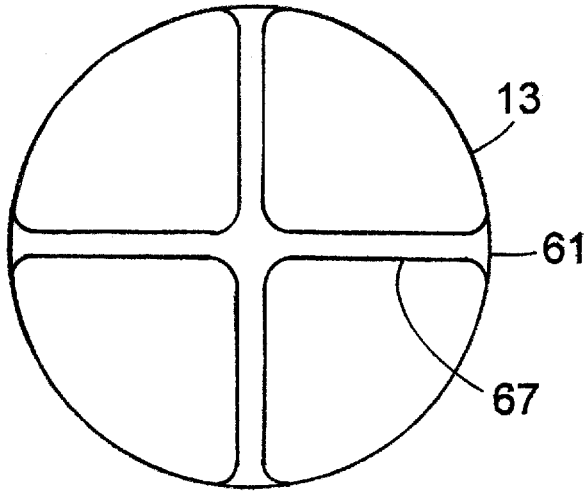

FIG. 3 is a plan view of the base of the outer container similar to FIG. 2 but showing an alternate design for the protrusions and indentations.

Figure 3A:
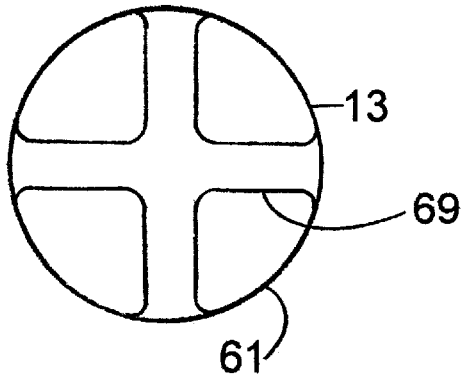

FIG. 3*a* is a plan view of the base of the inner container showing the same alternate design as shown in FIG. 3.

Figure 3B:
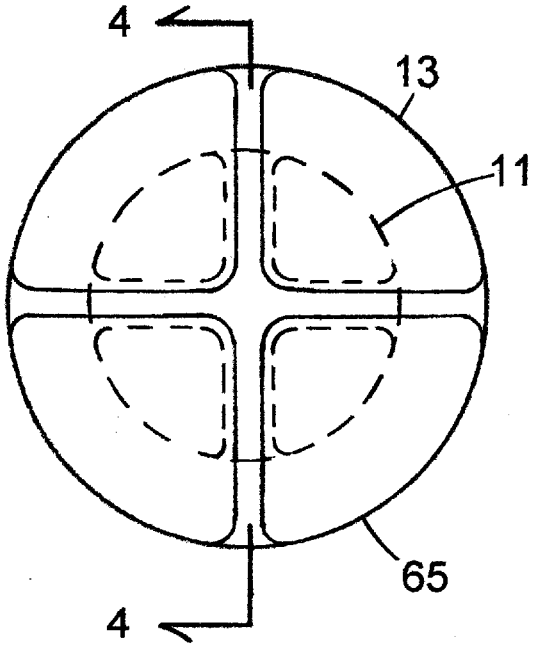

FIG. 3*b* is a plan view of the base of the outer container with the base of the inner container shown in phantom in place on the base of the outer container.

Figure 4:
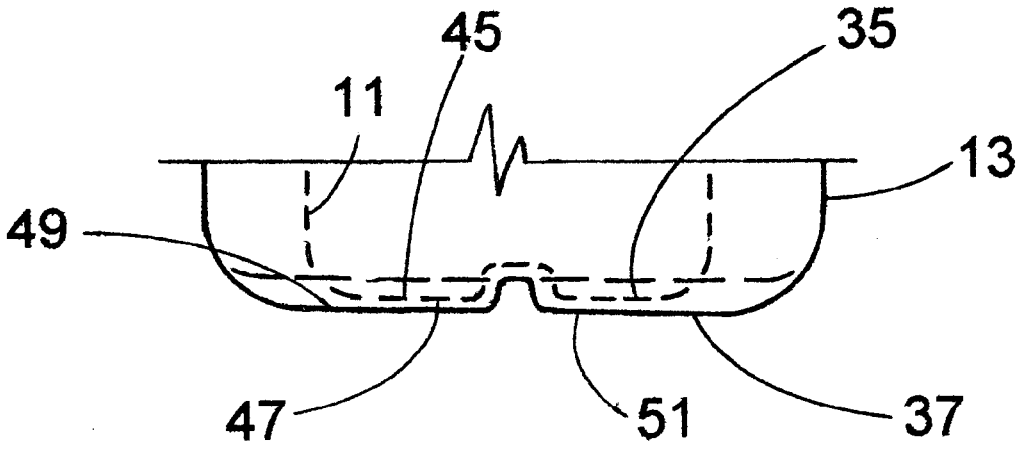

FIG. 4 is a side elevation of the base of the outer container showing the cross design with an inner container shown in phantom.

DETAILED DESCRIPTION OF THE NUMERALS

| NUMERAL | DESCRIPTION OF ELEMENT |
|---|---|
| 11 | Inner Container |
| 13 | Outer Container |
| 15 | Longitudinal Axis |
| 17 | Upper End of the Inner Container |
| 19 | Neck of the Inner Container. |
| 21 | Central Opening of the Inner Container |
| 23 | Upper End of the Outer Container |
| 25 | Neck of the Outer Container |
| 27 | Central Opening |
| 29 | Alternate Opening |
| 31 | Lower End of the Inner Container |
| 33 | Lower End of the Outer Container |
| 35 | Base Plate of the Inner Container |
| 37 | Base Plate of the Outer Container |
| 39 | Base Cap of the Outer Container |
| 41 | Body of the Inner Container |
| 43 | Body of the Outer Container |
| 45 | Inside Surface of the Base Plate - Inner Container |
| 47 | Outside Surface of the Base Plate - Inner Container |
| 49 | Inside Surface of the Base Plate - Outer Container |
| 51 | Outside Surface of the Base Plate - Outer Container |
| 53 | Projections on the Base Plate - Outer Container |
| 55 | Indentations on the Base Plate - Outer Container |
| 57 | Projections on the Base Plate - Inner Container |
| 59 | Center Point |
| 61 | Circular Periphery |
| 63 | Radial Sides |
| 65 | Rounded Ends |
| 67 | Projections - Outer Container |
| 69 | Indentations |

DETAILED DESCRIPTION OF THE PREFERRED EMBODIMENT

Figure 1:
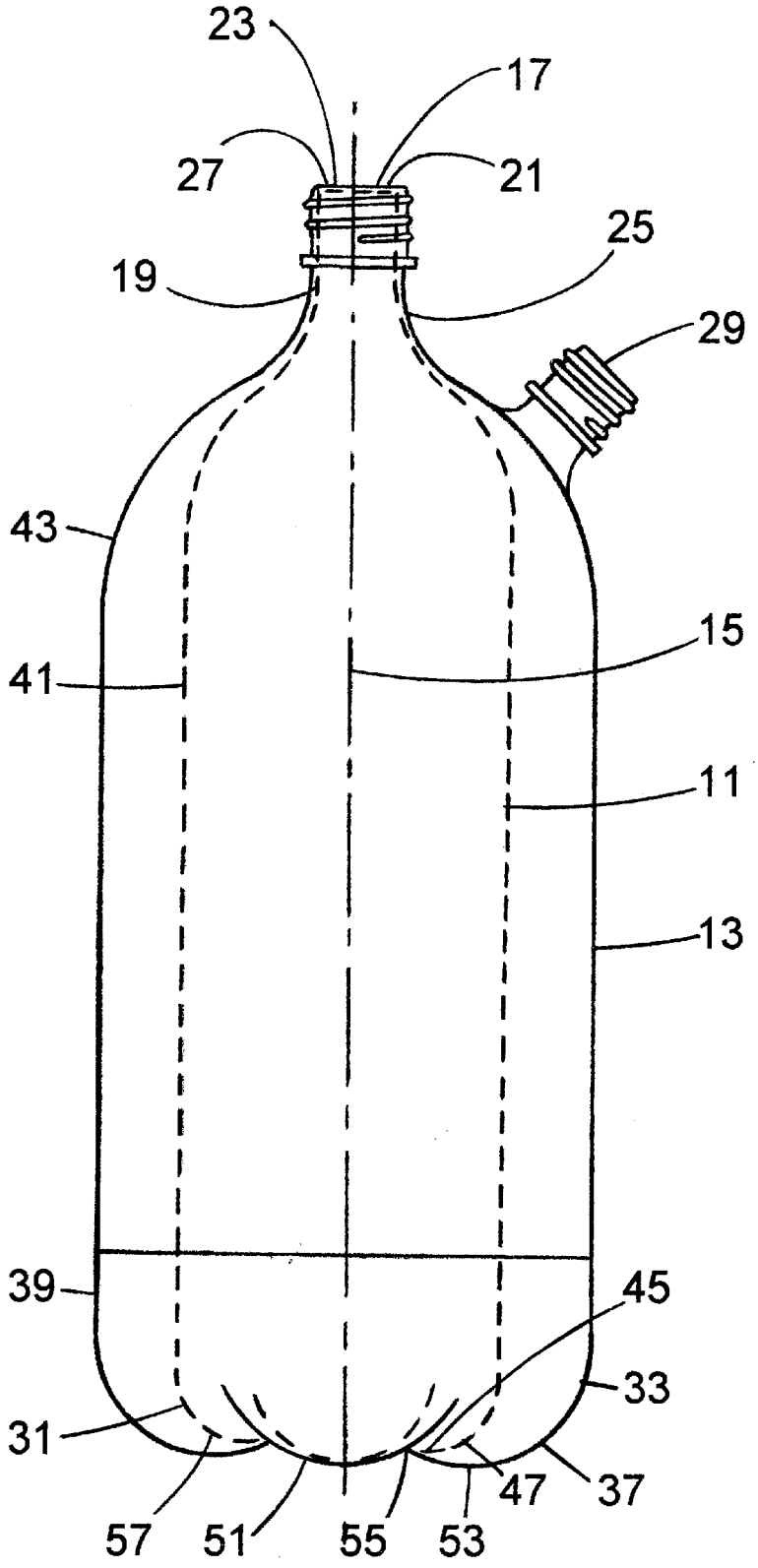
FIG. 1 is a side elevation of the dual container showing the inner container in phatom secured at the central opening and at the base of the outer container.

Referring now to the drawings and more particularly to FIG. 1, the dual container is shown utilizing cylindrical bottles of the design frequently in use today but with an inner container 11 located concentrically within an outer container 13. It is to be understood that the inner container 11 and the outer container 13 need not be cylindrical and containers of various shapes may be used. Furthermore, the inner container 11 and the outer container 13 need not have the same shape. However, the inner container 11 and the outer container 13 must, in general, have a common longitudinal axis 15. This provides the necessary balance so that regardless of whether the inner container 11 or the outer container 13 or both are partially or totally empty the dual container has stability.

Specifically, both the inner container 11 and the outer container 13 are intended for the storage of products, possibly the same product to permit successive usage and thus enhanced freshness or different products but most likely complementary products that can be used at the same or different occasions.

The inner container, as shown in FIG. 1, has an upper end 17 and at the upper end 17 is reduced in diameter forming a neck 19 and a central opening 21. Similarly, the outer container 13 has an upper end 23 and the upper end 23 is reduced in diameter forming a neck 25 and a central opening 27. The neck 19 of the inner container 11 is forced into the neck 25 of the outer container 13 thereby leaving only the central opening 21 of the inner container 11 to provide access to the product in the inner container. It is essential that the neck 19 of the inner container 11 not only be firmly secured into the neck 25 of the outer container 13 but that there be no possibility of leakage between the two necks 19, 25. With plastic construction, fusion would be one way to assure the necessary sealing and the use of welding and heat treatments would be necessary with metal containers. In some situations, a threaded connection (not shown) could be made with a seal (not shown) but the seal could not cause any contamination to the product inside either the inner container or the outer container. Still another technique would be to utilize a tight press fit by thermally expanding the neck 25 of the outer container 13 and forcing the neck 19 of the inner container 11 into the neck 25 of the outer container 13 and then cooling the neck 25.

Since the central opening 27 of the outer container 13 is blocked by the central opening 21 of the inner container 11, an alternate opening 29 is provided just below the neck 25 of the outer container 13 to permit access to the product in the outer container 13.

At the opposite end from its upper end 17, the inner container 11 has a lower end 31. Similarly, the outer container 13 has a lower end 33. The inner container 11 has a base plate 35 at the lower end 31. The outer container 13 in the same manner, has a base plate 37. For assembly purposes, the outer container 13 requires a base cap 39 which is generally shaped like a cup and is secured to the outer container 13 in the final assembling of the dual container with the base cap 39 of the outer container 13 being secured last of all. The inner container could have a base cap (not shown) but the inner container 11 may be formed in one piece.

Between the base plate 35 of the inner container 11 and the upper end 17, the inner container 11 has a body 41 which in the illustrated version is generally cylindrical and the outer container 13 has a body 43 between the upper end 23 and the base cap 39 of the outer container 13.

In FIG. 1 the base caps each have a base surface. Each base surface has an inner surface within its respective container and an outside surface outside its respective container. The base plate 37 of the outer container 13 is, of course, a part of the base cap 39. As seen in FIG. 1, the base plate 35 of the inner container 11 has an inside surface 45 and an outside surface 47 and the base plate 37 of the outer container 13 has an inside surface 49 and an outside surface 51. The configuration shown in FIG. 1 generally resembles a commonly used base plate configuration and confirms that existing container designs can be used to construct a dual container as contemplated by the instant invention. However, the design of the base plate 37 shown in FIG. 1 was previously only intended for use with a single container and not with a dual container and the inclusion of projections on the outside surface 51 of the base plate 37 with resulting indentations 55 on the inner surface 49 of the base plate 51 was previously intended only to provide a secure footing for the container and not as a means of securing the inner container 11 to the outer container 13 at the base plates 35, 37.

The base cap 39 of the outer container 13 is sealed onto the outer container 13 after the inner container 11 is secured at the neck 19. As shown in FIG. 2A And FIG. 4 the base plate 35 of the inner container 11 has indentations 55 on the inside surface 45 of the base plate 35 and a matching protrusion 57 on the outside surface 47 the base plate 35 of the inner container 11. In the same fashion, the base plate 37 of the outer container 13 has some form of indentation on 55 on the inside surface 49 of the base plate 39 and a matching protrusion 53 on the outside surface of the base plate 37. The indentations 55 and the protrusions 53 may be of various configurations but, in accordance with this invention, must be sufficiently similar so that the inner container 11 is retained at its lower end 31 as a result of protrusions 57 on the outside surface of the base plate 35 of the inner container 11 being held by the indentations 55 on the inside surface 51 of the base plate 37 of the outside container 13. It would be possible, as will be subsequently explained and as is shown in FIG. 3, 3*a* and 3*b* to reverse the indentations 55 and the protrusions 57.

The projections 53 on the base plate 37 of the outer container 13 shown in FIG. 1, are best used with the inner container 11 and the outer container 13 being cylindrical. In that situation, the base plate 35 of the inner container 11 and the base plate 37 of the outer container 13 are both circular and accordingly each has a center point 59 and a circular periphery 61. As best seen in FIGS. 1, 2 and 2*b*, the projections 53,57 and indentations 55 of both the inner container and the outer container 13 each have an elongated configuration with radial sides 63 which are generally divergent originating at the center point 59 of the base plates 35,37 which radial sides 63 turn toward each another to form a rounded end 65 adjacent to the periphery 61 of each of the base plates 35,37.

The projections 57 on the outside surface 51 of the base plate 35 of the inner container 55 in the inner surface 49 of the base plate 37 of the outer container 13. The result is a sufficient interlocking of the two base plates 35,37 to prevent the inner container 11 from moving to a degree that damage will occur to the inner container 11 most likely at the area of the neck 19 of the inner container 11 due to pendulum like swinging of the inner container 11 within the outer container 13. This would most likely occur if the outer container 13 was empty and the inner container 11 was full and the dual container was placed on its side.

The interlocking of the projections 57 and indentations 55 does not form a rigid lock but does provide sufficient retention to prevent the degree of movement that would cause damage.

In FIG. 3, a different embodiment of projections 67 on the inside surface 49 of the base plate 37 of the outer container 13 and indentations 69 is shown. Instead of the configuration shown in FIGS. 1, 2, 2*a* and 2*b*, a cross of rectangular cross-section is used to engage the indentation 69. As seen in FIG. 5, the base plate 37 of the outer container 13 has a raised cross of rectangular cross section, which is the projection 67 and which engages the indentation 69 in the form of a cross in the outer surface of the base plate 35 of the inner container 11. The indentation 69 in the base plate 35 of the of the inner container 11 must be slightly larger than the projection 67 of base plate 37 of the outer container 13 to permit easy assembly. Needless to say, numerous versions of projections and indentations may be used to prevent the unwanted movement of the inner container 11. Even the combination of one projection that is secured to one indentation in the base plates 35,37 will provide the needed retention. However, the outer surface 51 of the outer base plate must still provide a stable area to maintain the dual container in an upright position.

If desired, it would also be possible to bond the base plate 35 of the upper container 11 to the base plate 37 of the outer container 13 by any type of fusion of adhesion.

Thus, the scope of the invention should be determined by the appended claims and their legal equivalents, rather than by the examples provided herein.

We claim:

1. A dual container comprising:

an outer container having an upper end and a lower end, the upper end of the outer container having a neck forming a central opening, the end of the outer container including a base plate, the base plate of the outer container having an inside surface, the outer container having an alternate opening below and adjacent the upper end of the outer container; and an inner container having an upper end and a lower end, the upper end of the inner container having a neck forming an opening and the lower end of the inner container including a base plate having an outside surface, the neck of the inner container being sealed into the neck of the outer container one base plate having projections and the other base plate having indentations to retain the inner container within the outer container.

2. A dual container according to claim 1 wherein the outside surface of the base plate of the inner container includes projections and the inside surface of the base plate of the outer container includes indentations.

3. A dual container according to claim 1 wherein the outside surface of the base plate of the inner container includes projections and the inside surface of the base plate of the outer container includes indentations, the base plate of the inner container and the base plate of the outer container both being circular and having a center point and a periphery, both the projections and the indentations having two generally radial sides extending divergently from the center of the base plate, the radial sides curving into one another to form a rounded end adjacent the periphery of the base plate.

4. A dual container according to claim 1 wherein the outside surface of the base plate of the inner container includes projections and the inside surface of the base plate of the outer container includes indentations, both the projections and the indentations being in the form of a cross.

5. A dual container comprising:

an outer container with a circular cross section having an upper end and a lower end, the upper end having a neck forming a central opening, the lower end of the outer container including a base cap with a base plate, the base plate of the outer container having an inside surface, the inside surface having indentations, the outer container further including a cylindrical body section between the upper section and the base cap of the outer container, the base cap of the outer container being secured to the cylindrical body section of the outer container, the outer container further including an alternate opening in the cylindrical body section adjacent the neck;

an inner container with a circular cross section having an upper end and a lower end, the upper end having a neck forming a central opening, the neck of the inner container being secured within the neck of the outer container, the lower end of the inner container including a base cap with a base plate, the base plate of the inner container having an outside surface, the outside surface having projections, the inner container further including a cylindrical body section between the upper end and the base cap of the inner container being secured to the cylindrical body section of the inner container, the projections of the base plate of the inner container being secured in the indentations of the base plate of the outer container.

6. A dual container comprising:

an outer container with a circular cross section having an upper end and a lower end, the upper end having a neck forming a central opening, the lower end of the outer container including a base cap with a base plate, the base plate of the outer container having an inside surface, the inside surface having indentations, the outer container further including a cylindrical body section between the upper section and the base cap of the outer container, the base cap of the outer container being secured to the cylindrical body section of the outer container, the outer container further including an alternate opening in the cylindrical body section adjacent the neck;

an inner container with a circular cross section having an upper end and a lower end, the upper end having a neck forming a central opening, the neck of the inner container being secured within the neck of the outer container, the lower end of the inner container including a base plate, the base plate of the inner container having an outside surface, the outside surface having projections, the inner container further including a cylindrical body section between the upper end and the base plate of the inner container being secured to the cylindrical body section of the inner container, the projections of the base plate of the inner container being secured in the indentations of the base plate of the outer container, the inner container and the outer container generally having a common longitudinal axis.

* * * * *